US006709293B2

(12) United States Patent
Mori et al.

(10) Patent No.: US 6,709,293 B2
(45) Date of Patent: Mar. 23, 2004

(54) PRINTED-CIRCUIT BOARD CONNECTOR

(75) Inventors: Fumikatsu Mori, Niwa-gun (JP); Yoshiaki Kato, Niwa-gun (JP)

(73) Assignee: Kabushiki Kaisha Tokai Rika Denki Seisakusho, Aichi (JP)

( * ) Notice: Subject to any disclaimer, the term of this patent is extended or adjusted under 35 U.S.C. 154(b) by 0 days.

(21) Appl. No.: 10/213,028

(22) Filed: Aug. 6, 2002

(65) Prior Publication Data

US 2003/0032314 A1 Feb. 13, 2003

(30) Foreign Application Priority Data

Aug. 9, 2001 (JP) ..... 2001-242624

(51) Int. Cl.[7] ..... H01R 13/648
(52) U.S. Cl. ..... 439/607
(58) Field of Search ..... 439/607, 567, 439/569, 79

(56) References Cited

U.S. PATENT DOCUMENTS

| | | | | |
|---|---|---|---|---|
| 4,826,442 A | | 5/1989 | Douty et al. | 439/92 |
| 5,257,948 A | | 11/1993 | Peterson | 438/571 |
| 5,551,891 A | | 9/1996 | Huss, Jr. | 439/567 |
| 5,580,274 A | | 12/1996 | Tsair | 439/571 |
| 5,827,089 A | | 10/1998 | Beck, Jr. | 439/567 |
| 5,865,645 A | | 2/1999 | Embo et al. | 439/567 |
| 5,899,771 A | | 5/1999 | Clark et al. | 439/567 |
| 5,980,314 A | * | 11/1999 | Roberts | 439/567 |
| 6,280,248 B1 | | 8/2001 | Mitra | 439/571 |

FOREIGN PATENT DOCUMENTS

| | | |
|---|---|---|
| EP | 0 366 964 | 5/1990 |
| EP | 0 872 919 | 10/1998 |
| GB | 2 220 805 | 1/1990 |
| GB | 2 239 135 | 6/1991 |
| WO | WO 96/36094 | 11/1996 |

* cited by examiner

*Primary Examiner*—Tulsidas C. Patel
(74) *Attorney, Agent, or Firm*—Synnestvedt & Lechner LLP

(57) ABSTRACT

A connector mounted on a printed-circuit board includes a case and a plurality of terminals extending from the case. A base is arranged on a bottom surface of the case. Two metal plates are arranged on the base. Soldering is performed with the two metal plates and the terminals inserted through the printed-circuit board. This facilitates the coupling of the connector to the printed-circuit board. The base and the two metal plates are arranged within an area defined by the case. This decreases the area occupied by the connector on the printed-circuit board.

9 Claims, 3 Drawing Sheets

PRINTED-CIRCUIT BOARD CONNECTOR

BACKGROUND OF THE INVENTION

The present invention relates to a connector, and more particularly, to a printed-circuit board connector.

In the prior art, a printed-circuit board connector has a case and two screw fastening portions, which extend from two sides of the case. The connector is mounted on a printed-circuit board by fastening the screw fastening portions to the board with screws.

However, the screws used to fix the connector increase the number of required components. Further, the screw fastening operation increases the number of operations required to mount the connector to the printed-circuit board. In addition, the screw fastening portions, which extend from the sides of the connector main body, increases the area occupied by the connector on the printed-circuit board.

SUMMARY OF THE INVENTION

It is an object of the present invention to provide a printed-circuit board connector that is easily mounted on a printed-circuit board and has a decreased printed-circuit board occupying area.

To achieve the above object, the present invention provides a connector mounted on a printed-circuit board. The connector includes a case, a plurality of terminals extending from the case, and a coupler for coupling the case to the printed-circuit board. The coupler includes a base arranged on a bottom surface of the case, and at least one metal plate arranged on the base and partially inserted through the printed-circuit board. The base and the at least one metal plate are arranged within an area defined by the case and the terminals.

Other aspects and advantages of the present invention will become apparent from the following description, taken in conjunction with the accompanying drawings, illustrating by way of example the principles of the invention.

BRIEF DESCRIPTION OF THE DRAWINGS

The invention, together with objects and advantages thereof, may best be understood by reference to the following description of the presently preferred embodiments together with the accompanying drawings in which:

FIG. 1(*b*) is a side view showing the connector of FIG. 1(*a*);

FIG. 2(*b*) is a bottom view showing the connector of FIG. 1(*a*);

FIG. 3(*b*) is a rear view showing the connector of FIG. 3(*a*) after the connector is mounted on the printed-circuit board.

DETAILED DESCRIPTION OF THE PREFERRED EMBODIMENTS

Figure 1:
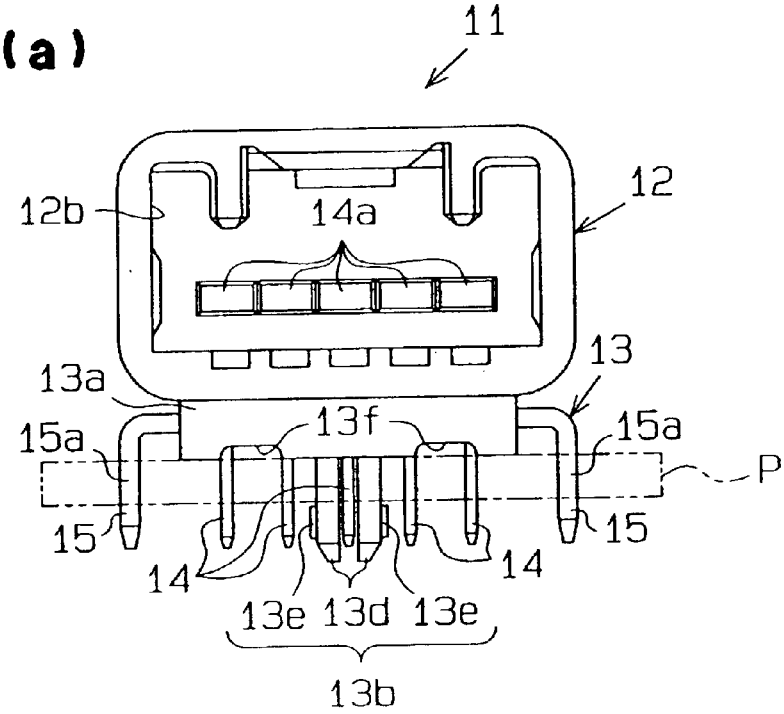
FIG. 1(*a*) is a rear view showing a connector according to a first embodiment of the present invention.
Figure 1:
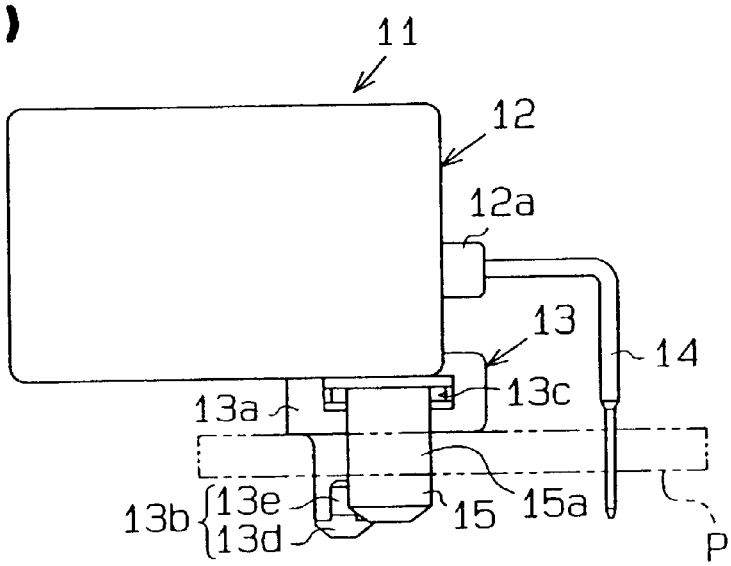

In the drawings, like numerals are used for like elements throughout.

A printed-circuit board female connector 11 according to a first embodiment of the present invention will now be discussed with reference to FIGS. 1(*a*), 1(*b*), 2(*a*), and 2(*b*).

Referring to FIGS. 1(*a*) and 1(*b*), the printed-circuit board female connector 11 includes a resin box-like case 12 and a coupler 13.

The coupler 13 includes an elongated parallelepiped-like base 13*a*, a support 13*b*, and metal plates 15. The base 13*a* is made of resin and formed integrally with the case 12. The support 13*b* is made of resin and formed integrally with the base 13*a*.

As shown in FIGS. 1(*b*) and 2(*a*), a projection 12*a* extends from one side of the case 12. A plurality of (in this case, five) metal terminals 14, which are spaced from one another by predetermined intervals, extend from the projection 12*a*. The middle portion of each terminal 14 is bent at a substantially right angle.

As shown in FIG. 1(*a*), a socket 12*b*, which receives a male connector (not shown), is defined in the side of the case 12 that is opposite to the projection 12*a*. A plurality of (in this case, five) fitting portions 14*a* are formed in the inner surface of the socket 12*b*. The fitting portions 14*a* are made of metal and are electrically connected to the basal end of each terminal 14.

Figure 2A:
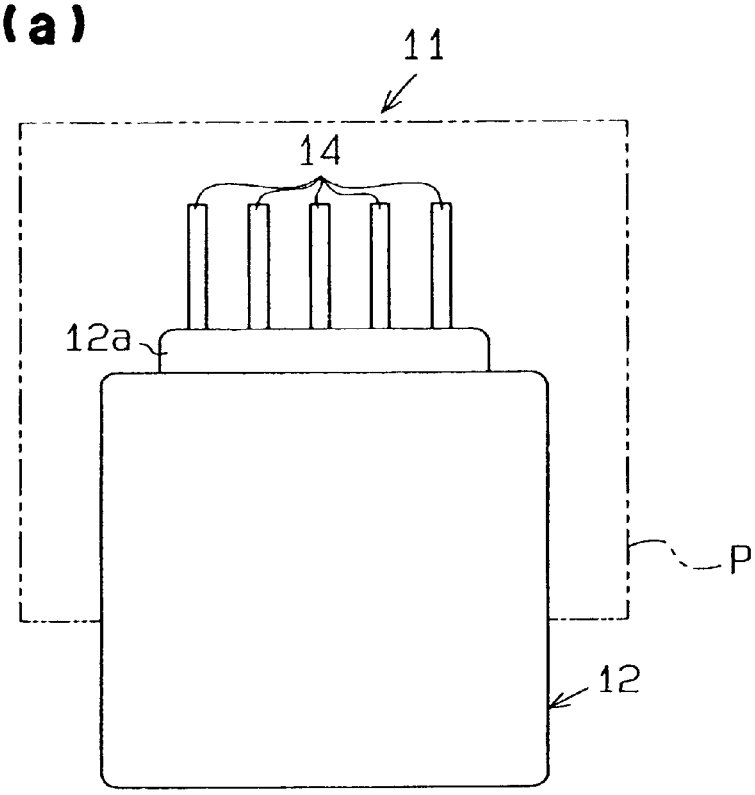
FIG. 2(*a*) is a plan view showing the connector of FIG. 1(*a*)
Figure 2B:
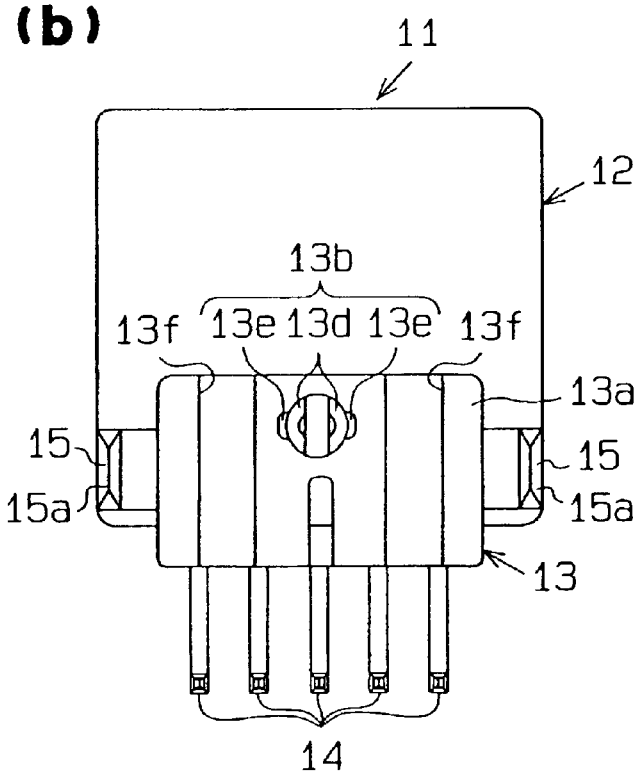

The base 13*a* is formed on the bottom surface (as viewed in FIGS. 1(*a*) and 1(*b*)) of the case 12. One end of the base 13*a* extends from the case 12 in the same direction as the terminals 14. The end is located under the projection 12*a*. As shown in FIGS. 2(*a*) and 2(*b*), the longer sides of the base 13*a* are shorter than the case 12. In other words, the base 13*a* has two short side surfaces that are located inward from two corresponding side surfaces of the case 12. A rectangular opening 13*c* is formed in each short side surface of the base 13*a*. In each opening 13*c*, one of the flat metal plates 15 is press-fitted and fixed.

Each metal plate 15, which extends from the base 13*a* in the longitudinal direction of the base 13*a*, is bent in a direction opposite to the bottom surface of the case 12 at a substantially right angle to form a bent portion 15*a*. The distal end of each metal plate 15 is tapered. The bent portion 15*a* of each metal plate 15 is inserted in a hole formed in a printed-circuit board P. It is preferred that the distance between the bent portions 15*a* of the two metal plates 15 be substantially the same as the length of the case 12. That is, each metal plate 15 is bent at a predetermined position so that the distance between the two bent portions 15*a* is substantially the same as the length of the case 12. As shown in FIG. 1(*b*), the surface of each metal plate 15 facing the terminals 14 is substantially flush with the surface of the case 12 facing the terminals 14. Thus, the metal plates 15 are located as close as possible to the terminals 14.

As shown in FIG. 2(*b*), the support 13*b* is formed on the base 13*a* at the middle portion of the bottom surface. The support 13*b* is separated from the center of the base 13*a* toward the center of the case 12. The support 13*b* has two resin flexible pieces 13*d*, which extend vertically from the bottom surface of the base 13*a*. The two flexible pieces 13*d* are opposed to each other and are each semi-cylindrical. A protrusion 13*e* is formed on the distal end of each flexible piece 13*d*. The two protrusions 13*e* face opposite directions. Further, each protrusion 13*e* is separated from the basal end of the associated flexible piece 13*d* by a distance corresponding to the thickness of the printed-circuit board P. The two flexible pieces 13*d* are inserted through the printed-circuit board P and are slightly longer than the bent portions 15*a* of the metal plates 15. The two bent portions 15*a* and the two flexible pieces 13*d* are inserted through the printed-circuit board P to temporarily fix the case 12 to the printed circuit board P.

Two grooves 13*f* are formed in the bottom surface of the base 13*a* with the support 13*b* located in between. The grooves 13*f* extend parallel to each other in a direction perpendicular to the longitudinal direction of the base 13*a*.

The procedure for coupling the female connector 11 to the printed-circuit board P will now be described.

The printed-circuit board P, which has a plurality of holes (not shown) associated with the support 13*b*, the terminals 14, and the metal plates 15, is first prepared. The female connector 11 is arranged above the printed-circuit board P so that the bottom surface of the base 13*a* faces the printed circuit board P. Then, the support 13*b*, the terminals 14, and the metal plates 15 are inserted in the associated holes. In this state, the two flexible pieces 13*d* of the support 13*b* are flexed toward each other when inserted through the associated holes. As the flexible pieces 13*d* extend out of the printed-circuit board P, the flexible pieces 13*d* return to their original state from the flexed state. This hooks the protrusions 13*e* to the bottom surface of the printed-circuit board P. As a result, the female connector 11 is temporarily fixed to the printed-circuit board P so that it does not fall out of the board P. When the female connector 11 is in a temporarily fixed state, the metal plates 15 and the terminals 14 extend out of the bottom surface of the printed-circuit board P, as shown in FIG. 1(*a*).

Then, flow soldering is performed to solder the metal plates 15 and the terminals 14 to the bottom surface of the printed-circuit board P. When doing so, the female connector 11 is held in the temporarily fixed state by the two protrusions 13*e* engaging the bottom surface of the printed-circuit board P. Thus, soldering is easily and stably performed. The coupling of the female connector 11 is completed in this manner.

Subsequently, when using the female connector 11, a male connecter (not shown) is fitted to the socket 12*b*. When doing so, the metal plates 15 and the support 13*b* absorb the force applied to the female connector 11. Therefore, the force applied to the terminals 14 is relatively small when the male connector is attached to or detached from the female connector.

The female connector 11 of the first embodiment has the advantages described below.

(1) The base 13*a* is formed integrally with the bottom surface of the case 12, and the two metal plates 15 are attached to the sides of the base 13*a*. The distance between the bent portions 15*a* of the two metal plates 15 is substantially the same as the length of the case 12. Accordingly, the connector 11 is easily mounted on the printed-circuit board P without using screws. Further, the area of the printed-circuit board P occupied by the connector 11 is decreased.

When projected toward the printed-circuit board P, the projected area of the connector 11 is defined by the contour of the case 12 and the terminals 14. A portion of the base 13*a* extends from the bottom surface of the case 12 within the contour. Thus, the coupler 13 including the base 13*a* is mostly arranged in the projection area. This increases the area of the printed-circuit board to which components may be mounted.

(2) The protrusions 13*e* formed on the flexible pieces 13*d* hold the connector 11 on the printed-circuit board P. That is, the connector 11 is temporarily fixed in a state in which the metal plates 15 and the terminals 14 are inserted in the holes of the printed-circuit board P. This reduces the number of operations required to mount the female connector 11 on the printed-circuit board P in comparison to the mounting procedure of the prior art that uses screws.

(3) The metal plates 15 and the terminals 14 are soldered to the printed-circuit board P in a state in which the female connector 11 is temporarily fixed to the printed-circuit board P. Thus, the female connector 11 is securely mounted on the printed-circuit board.

(4) The two metal plates 15 are located near the terminals 14. Accordingly, when a male connector is attached to or detached from the female connector 11, the metal plates 15 absorb most of the force applied to the female connector 11. Thus, the force applied to the terminals 14 is relatively small.

(5) The support 13*b* and the metal plates 15 are separated from the center of the case 12 and located near the terminals 14. Thus, even if force acting in a clockwise or counter-clockwise direction, as viewed in FIG. 2(*a*), is applied to the female connector 11 when the male connector is attached or detached, the support 13*b* and the metal plates 15 absorb the force. Thus, the force applied to the terminals 14 is rather small.

(6) The metal plates 15 are formed separately from the base 13*a*. This inhibits the transmission of heat to the case 12 during soldering.

It should be apparent to those skilled in the art that the present invention may be embodied in many other specific forms without departing from the spirit or scope of the invention. Particularly, it should be understood that the present invention may be embodied in the following forms.

Figure 3A:
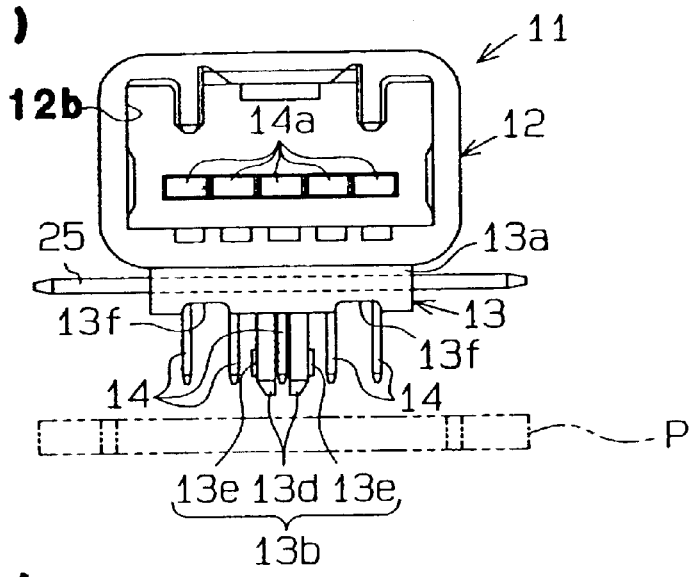
FIG. 3(*a*) is a rear view showing a connector according to a second embodiment of the present invention before the connector is mounted on a printed-circuit board.
Figure 3B:
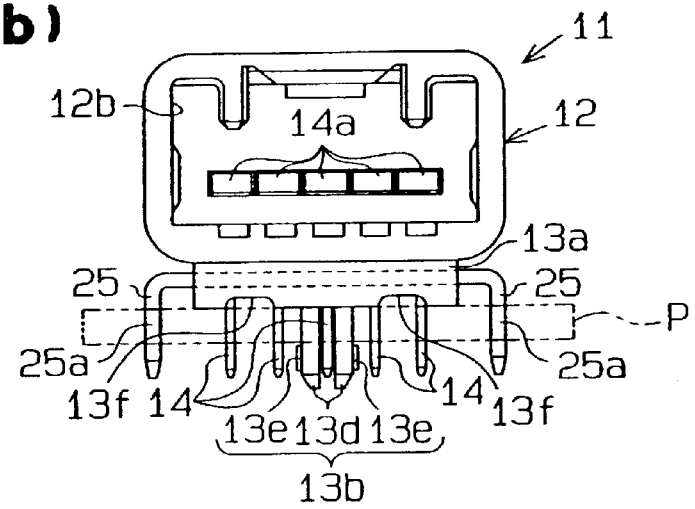

(A) With reference to FIGS. 3(*a*) and 3(*b*), a single metal plate 25 may be insert molded in the base 13*a*. In this case, the single flat metal plate 25 is insert molded so that the two ends of the metal plate 25 extend out of the base 13*a*. The two extending portions of the metal plates 25 are bent to form two bent portions 25*a*. The distance between the two bent portions 25*a* is substantially the same as the length of the case 12. The metal plates 25, the support 13*b*, and the terminals 14 are inserted through associated holes of the printed-circuit board P so that the female connector 11 is temporarily fixed to the printed-circuit board. The insert molding of the single metal plate 25 in the base 13*a* eliminates the press-fitting operation of the first embodiment in which the metal plates 15 are press-fitted in the openings 13*c*.

Figure 4:
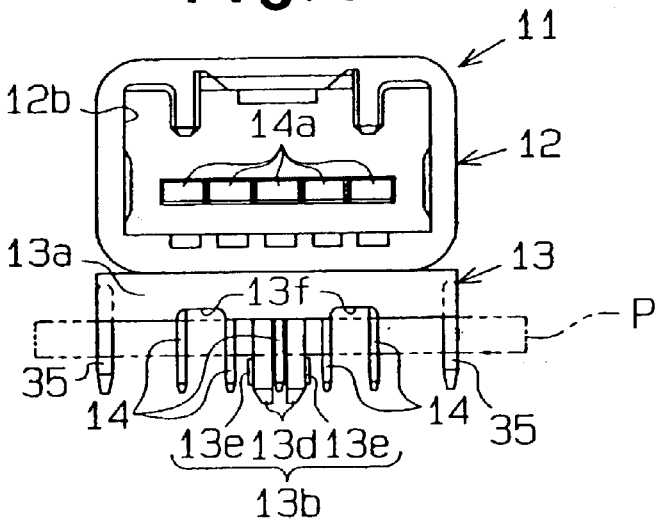
FIG. 4 is a rear view showing a connector according to a third embodiment of the present invention.

(B) With reference to FIG. 4, two metal plates 35 may be insert-molded in the base 13*a*. Each metal plate 35 extends vertically from the bottom surface of the base 13*a* at one of the two ends of the base 13*a*. In this case, the surface of the base 13*a* facing the terminals 14 is substantially flush with the surface of the case 12 facing the terminals 14. Accordingly, the coupler 13 does not overhang from the case 12. Since the two metal plates 35 are insert molded in the base 13*a*, the press-fitting and bending operations of the metal plates 15 in the first embodiment are eliminated.

(C) Instead of using the metal plates 15, only one metal plate 15 may be used. In this case, the opening 13*c* extends through the base 13*a*, and the single metal plate 15 is press-fitted in the opening 13*c* so that the ends of the metal plate 15 extend out of the base 13*a*. The two portions extending out of the metal plate 15 are bent to form two bent portions 15*a*. The distance between the two bent portions 15*a* is substantially the same as the length of the case 12.

(D) The distance between the two holes of the printed-circuit board P associated with the metal plates 15 may be slightly greater than or less than the distance between the two bent portions 15*a*. In this case, the two metal plates 15 are inserted in the associated holes of the printed-circuit board P in a flexed state. The flexing of the metal plates 15 produces a resilient force. The resilient force fixes the metal plates 15 in the associated holes of the printed-circuit board P.

(E) The two metal plates 15 may extend from the longer sides of the base 13*a* instead of the shorter sides of the base 13*a*. In this case, it is preferred that the metal plates 15 do not overhang from the contour of the case 12 and the terminals 14. This arranges the coupler 13, which includes the metal plates 15, within the area where the female connector 11 is projected on the printed-circuit board P.

(F) The number of the metal plates 15 is not limited to one or two and may be three or more.

(G) The metal plates 15 and the support 13*b* may be arranged along the same line.

(H) The support 13*b* does not necessarily have to have the protrusions 13*e*.

(I) The support 13*b* may be eliminated.

(J) The support 13*b* may be shorter than the bent portions 15*a* of the metal plates 15.

(K) Instead of flow soldering, reflow soldering may be performed to solder the female connector 11.

The present examples and embodiments are to be considered as illustrative and not restrictive, and the invention is not to be limited to the details given herein, but may be modified within the scope and equivalence of the appended claims.

What is claimed is:

1. A connector mounted on a printed-circuit board comprising:

a case;

a plurality of terminals extending from the case; and a coupler for coupling the case to the printed-circuit board, wherein the coupler includes:

a base arranged on a bottom surface of the case; and at least one metal plate arranged on the base and partically inserted through the printed-circuit board, wherein the base and the at least one metal plate are arranged within an area defined by the case and the terminals, wherein the at least one metal plate includes two metal plates, and wherein the base includes two second side surfaces, which are located inward from two first side surfaces of the case, and an opening formed in each of the two side surfaces to receive an associated one or the metal plates.

2. The connector according to claim 1, wherein the base and the case are made of resin and formed integrally, and wherein the at least one metal plate includes two metal plates, which extend from the base, and the distance between the two metal plates is substantially the same as the length of the case.

3. The connector according to claim 1, wherein the base is arranged near the terminals.

4. The connector according to claim 1, wherein the coupler further includes a support arranged on the base to hold the base on the printed-circuit board.

5. The connector according to claim 4, wherein the support includes two flexible pieces, which extend vertically from the bottom surface of the base and are inserted through the printed-circuit board, and two protrusions arranged on distal portions of the two flexible pieces and facing opposite directions.

6. The connector according to claim 5, wherein each protrusion is separated from the bottom surface of the base by a distance corresponding to the thickness of the printed-circuit board.

7. The connector according to claim 1, wherein the two metal plates are each bent in a direction opposite to the case so that the distance between the two metal plates is substantially the same as the length of the case.

8. A connector mounted on a printed-circuit board comprising:

a case;

a plurality of terminals extending from the case; and a coupler for coupling the case to the printed-circuit board, wherein the coupler includes:

a base arranged on a bottom surface of the case; and at least one metal plate arranged on the base and partially inserted through the printed-circuit board, wherein the base and the at least one metal plate are arranged within an area defined by the case and the terminals, wherein the at least one metal plate is a single metal plate insert molded in the base, and wherein the base includes two second side surfaces, which are located inward from two first side surfaces of the case, and wherein the metal plate has extending portions, each extending from one of the two side surfaces.

9. The connector according to claim 8, wherein the two extending portions of the metal plate are each bent in a direction opposite to the case so that the distance between the two ending portions is substantially the same as the length of the case.

* * * * *